US010415167B2

(12) United States Patent
Fukuba et al.

(10) Patent No.: US 10,415,167 B2
(45) Date of Patent: Sep. 17, 2019

(54) SEWING MACHINE

(71) Applicant: JUKI CORPORATION, Tama-shi, Tokyo (JP)

(72) Inventors: Naofumi Fukuba, Tama (JP); Daishi Kuramashi, Tama (JP)

(73) Assignee: JUKI CORPORATION, Tama-shi, Tokyo (JP)

( * ) Notice: Subject to any disclaimer, the term of this patent is extended or adjusted under 35 U.S.C. 154(b) by 522 days.

(21) Appl. No.: 14/986,803

(22) Filed: Jan. 4, 2016

(65) Prior Publication Data

US 2016/0194797 A1 Jul. 7, 2016

(30) Foreign Application Priority Data

Jan. 7, 2015 (JP) ..... 2015-001263

(51) Int. Cl.

*D05B 29/12* (2006.01)
*D05B 27/02* (2006.01)
*D05B 27/08* (2006.01)

(52) U.S. Cl.

CPC ..... *D05B 29/12* (2013.01); *D05B 27/02* (2013.01); *D05B 27/08* (2013.01)

(58) Field of Classification Search

CPC ..... D05B 29/12; D05B 27/02; D05B 27/08
USPC ..... 112/324, 323
See application file for complete search history.

(56) References Cited

U.S. PATENT DOCUMENTS 1,899,816 A * 2/1933 Maier ..... D05B 27/02 112/256
2,882,846 A * 4/1959 Coates ..... D05B 27/02 112/324
2,893,337 A * 7/1959 Irmscher ..... D05B 27/02 112/199

(Continued)

FOREIGN PATENT DOCUMENTS

CN 1140774 A 1/1997
CN 2501895 Y 7/2002

(Continued)

OTHER PUBLICATIONS

Notification of Reasons for Refusal dated Aug. 28, 2018 in Japanese Patent Application No. 2015-001263 (2 pages) with an English translation (2 pages).

(Continued)

*Primary Examiner* — Katharine Gracz
(74) *Attorney, Agent, or Firm* — Drinker Biddle & Reath LLP

(57) ABSTRACT

A sewing machine, in which a presser foot and a throat plate are detachable, includes a feed dog bracket, a feeding dog and a mounting portion. The feed dog bracket is driven according to a transfer direction of a fabric. The feeding dog transfers the fabric on the throat plate. The mounting portion detachably mounts the feeding dog on the feed dog bracket. The feeding dog includes a cam portion which is mounted on the mounting portion. The cam portion includes first, second and third cam surfaces. The first cam surface has a surface-contact with a first receiving surface of the mounting portion. The second cam surface has a line-contact with an end portion of a second receiving surface of the mounting portion. The third cam surface is pressed by a pressing member of the mounting portion.

18 Claims, 7 Drawing Sheets

(56) References Cited

U.S. PATENT DOCUMENTS

| | | | | |
|---|---|---|---|---|
| 3,980,032 | A | 9/1976 | Kleinschmidt et al. | |
| 4,311,105 | A * | 1/1982 | Buzzi | D05B 13/00 112/199 |
| 2010/0212563 | A1 * | 8/2010 | Mizuno | D05B 27/02 112/260 |

FOREIGN PATENT DOCUMENTS

| | | | |
|---|---|---|---|
| CN | 202202115 | U | 4/2012 |
| JP | S47-016267 | Y2 | 6/1972 |
| JP | S47-016268 | Y2 | 6/1972 |
| JP | S49-084253 | A | 8/1974 |
| JP | H10-118363 | A | 5/1998 |
| JP | 2004174120 | A | 6/2004 |

OTHER PUBLICATIONS

Notification of First Office Action dated Jul. 2, 2019 in Chinese Patent Application No. 201610009014.9 (8 pages) with an English translation (10 pages).

* cited by examiner

SEWING MACHINE

CROSS-REFERENCE TO RELATED APPLICATIONS

This application is based upon and claims the benefit of priority from Japanese Patent Application No. 2015-001263, filed on Jan. 7, 2015; the entire contents of which are incorporated herein by reference.

BACKGROUND OF INVENTION

1. Field of the Invention

The present invention relates to a sewing machine capable of performing various types of sewing.

2. Related Art

In a domestic sewing machine, since a single machine capable of performing diverse sewing such as straight sewing and zigzag sewing is required, a needle hole formed in a throat plate is formed to have an elongated shape having a wide horizontal width in order to cope with a needle swing. As a result, a feeding dog or a pressing foot which has also a concomitant wide horizontal width has been used.

However, when the pressing foot has a wide width, a position on which a needle is dropped in a fabric is covered with the pressing foot and thus it is impossible to perform sewing under a circumstance that a hand is made to position near the position of the needle, thereby decreasing an operating performance. As a result, in a sewing machine of the related art, a pressing foot is handled to be exchanged depending on a stitch pattern (for example, referring to JP-A-H10-118363).

However, in the above mentioned sewing machine of related art, the pressing foot can be exchanged, but the feeding dog cannot be exchanged in that the feeding dog are disposed inside a sewing machine bed portion and thus an exchange thereof is not easily made. As a result, since the straight sewing has to be performed by using the feeding dog which have a wide width coping with the zigzag sewing, it is impossible to sufficiently enhance the operating performance. Further, since the feeding dog appear or disappear in a wide range, there is concern over decrease of sewing quality such as fabric damages caused by the feeding dog.

An object of the present invention is to provide a transfer mechanism of a sewing machine in which a feeding dog can be easily exchanged.

SUMMARY OF INVENTION (1) A sewing machine, in which a presser foot and a throat plate are detachable in accordance with a stitch pattern, includes a feed dog bracket, a feeding dog and a mounting portion. The feed dog bracket is driven according to a transfer direction in which a fabric is transferred. The feeding dog transfers the fabric on the throat plate. The mounting portion detachably mounts the feeding dog on the feed dog bracket. The feeding dog includes a cam portion which is mounted on the mounting portion. The mounting portion includes a first receiving surface, a second receiving surface and a pressing member. The cam portion is inserted on the first receiving surface and the second receiving surface. The first receiving surface and the second receiving surface are formed in positions opposing to each other. The pressing member presses the inserted cam portion which is inserted between the first and second receiving surfaces, in an insertion direction. The cam portion includes a first cam surface, a second cam surface and a third cam surface. The first cam surface is a planar surface and has a surface-contact with the planar first receiving surface. The second cam surface has a line-contact with an end portion of the second receiving surface in a direction perpendicular to the insertion direction in which the cam portion is inserted. The third cam surface is pressed by the pressing member.

(2) in the sewing machine according to (1), a direction in which the pressing member presses the third cam surface is divided into a pressing direction in which the first cam surface presses the first receiving surface and the insertion direction in which the cam portion is inserted between the first and second receiving surfaces.

(3) In the sewing machine according to (1) or (2), the cam portion is arranged at an end portion of the feeding dog in the insertion direction.

(4) In the sewing machine according to any one of (1) to (3), the insertion direction of the cam portion is parallel to a direction in which the fabric is transferred by the feeding dog.

(5) In the sewing machine according to any one of (1) to (4), the mounting portion includes a positioning member which positions the feeding dog on the mounting portion, in a direction which is parallel to the first receiving surface and which is intersected with the insertion direction.

(6) In the sewing machine according to any one of (1) to (5), the cam portion includes a first continuous surface which is formed at an end portion of the first cam surface in the insertion direction, which is continued into the first cam surface and which has an arc shaped section.

(7) In the sewing machine according to any one of (1) to (6), the pressing member includes a pressure contact portion which presses the third cam surface. The cam portion has a second continuous surface which is continued into the first and third cam surfaces and which has an arc shaped section.

(8) In the sewing machine according to (7), the pressing member is a spring member which has the pressure contact portion.

(9) In the sewing machine according to (7), the pressing member is a latch mechanism which has the pressure contact portion.

(10) In the sewing machine according to any one of (1) to (6), the pressing member is a lever member which switches a position where the pressing member presses the third cam surface and a position where the pressing member is retreated from the third cam surface.

Advantageous Effect of Invention

The present invention includes a feed dog bracket in which an operation is given according to a transfer direction of a fabric, a feeding dog which transfers the fabric on a throat plate, and a mounting portion by which the feeding dog is detachably mounted to the feed dog bracket.

A face-to-face contact between a first cam surface and a first receiving surface and a line-to-line contact between a second cam surface and a second receiving surface are maintained by a pressing member, and thus the feeding dog is properly held and supported in the feed dog bracket. Meanwhile, when the feeding dog is pulled out against the pressing member in a direction opposite to an insertion direction, the feeding dog is detached therefrom and thus the feeding dog can be easily exchanged.

As a result, suitable feeding dog is exchanged depending on a stitch pattern, and thus quality of sewing can be improved.

DETAILED DESCRIPTION

Entire Configuration of Sewing Machine

Figure 1:
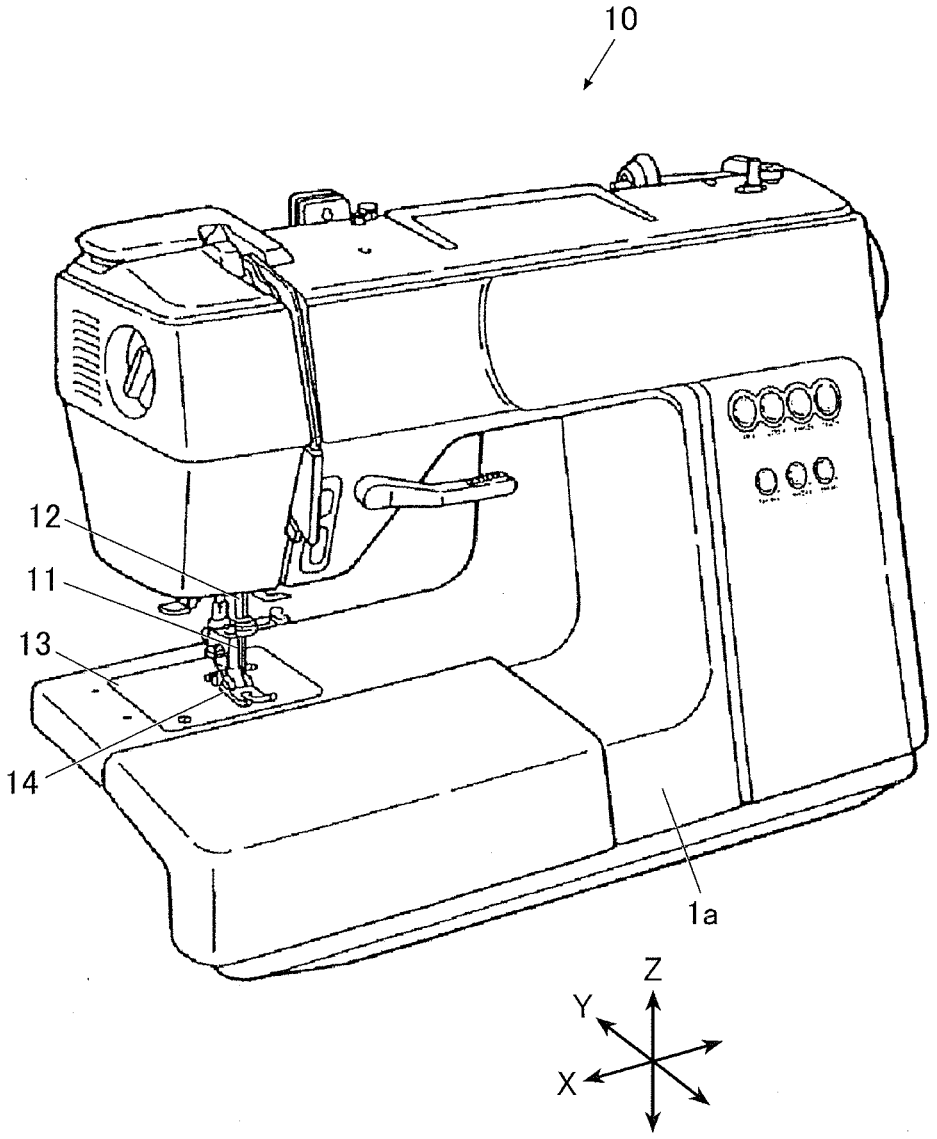
FIG. 1 is a perspective view illustrating a sewing machine according to an embodiment of the present invention.

Hereinafter, a sewing machine 10 according to an embodiment of the present invention will be described in detail with reference to drawings. FIG. 1 is a perspective view illustrating the sewing machine 10. On condition that this sewing machine 10 is placed on a horizontal plane, a surface of a throat plate 13 is horizontal, and a fabric, that is, a fabric is transferred on a top surface of the throat plate 13. Hereinafter, a transfer direction in which the fabric is transferred is set a Y axis, a direction in which is parallel to the top surface of the throat plate 13 and is perpendicular to the Y axis is set an X axis, and a direction in which is perpendicular to the throat plate 13 is set a z axis.

The sewing machine 10 includes a needle up and down moving mechanism that moves a needle rod 12 holding a needle 11 up and down, a transfer mechanism that transfers the fabric on the throat plate 13 by a certain pitch synchronizing with an up and down movement of the needle rod 12, a hook mechanism that captures an upper thread of the needle 11 and winds a lower thread round, and a balancing mechanism that moves up and down and raises the upper thread synchronizing with the needle rod, and the like, which are all known. Therefore, descriptions thereof will not be repeated here.

The needle up and down moving mechanism of the sewing machine 10 can perform a catch stitch by a needle swing along the X axis by supporting the needle rod 12 so as to swing to enable the needle 11 to reciprocate along the X axis and causing the needle rod 12 to swing with two times the period of the up and down movement of the needle rod 12.

In the needle up and down moving mechanism of the sewing machine 10, the needle rod can also be moved up and down without performing the needle swing, and thus a normal straight sewing or the catch stitch by a needle swing is selectively performed.

Here, since all of a presser foot 14 that presses and supports a fabric on the throat plate 13 from an upper part by a predetermined pressure and the feeding dog 20 that transfers the fabric by enabling a tip of a feeding dog to appear or disappear through an opening of the throat plate 13 have good linearity and fabric handling properties when widths thereof in the X-axis direction are formed to be narrow, it is desirable to use all of the presser foot 14 and the feeding dog having narrower width when the straight sewing in which a width in the X-axis direction ensuring the needle swing is not necessary is performed.

As a result, the presser foot 14 is detachably screwed to a supporting rod for supporting the presser foot 14, and thus the presser foot 14 having a narrow width in the X-axis direction for the straight sewing is exchanged for a presser foot (not shown) having a wider width in the X-axis direction for the catch stitch.

The feeding dog 20 is also detachably mounted to a feed dog bracket 15 as will be described below, and thus the feeding dog 20A (referring to FIG. 9) having a narrow width in the X-axis direction for the straight sewing is exchanged for the feeding dog 20 having a wider width in the X-axis direction for the catch stitch.

The throat plate 13 can be removed from a sewing machine bed portion, and thus a throat plate (not shown) in which an opening corresponding to the feeding dog 20A for the straight sewing is formed is exchanged for the throat plate 13 in which an opening corresponding to the feeding dog 20 for the catch stitch.

Transfer Mechanism

A transfer mechanism 2 of the sewing machine 10 includes a back and forth transfer shaft and a up and down transfer shaft that are rotated by torque of a motor (not shown) as a driving power source for sewing, the feed dog bracket 15 in which the feeding dog 20 (or 20A) is mounted via the mounting portion 50, a first transfer mechanism that ejects a reciprocating operation along the Y-axis direction from a rotation of the back and forth transfer shaft and transfers the operation to an end portion of the feed dog bracket, and a second transfer mechanism that ejects a reciprocating operation along the Z-axis direction from a rotation of the up and down transfer shaft and transfers the operation to another end portion of the feed dog bracket 15.

The reciprocating operation along the Y-axis direction and the reciprocating operation along the Z-axis direction are synthesized based on this configuration, and thus the feed dog bracket 15 gives an elliptical operation along the Y-axis direction to the feeding dog 20 (or 20A). When moving in an upper interval of the elliptical operation, the tip of the feeding dog appears or disappears through the opening of the throat plate 13 by moving along the transfer direction and thus a fabric is transferred by a predetermined pitch.

Feeding Dog

The feed dog bracket 15 includes the mounting portion 50 in which the feeding dog 20 is detachably mounted on the middle portion of an upper part in the Y-axis direction.

Figure 2:
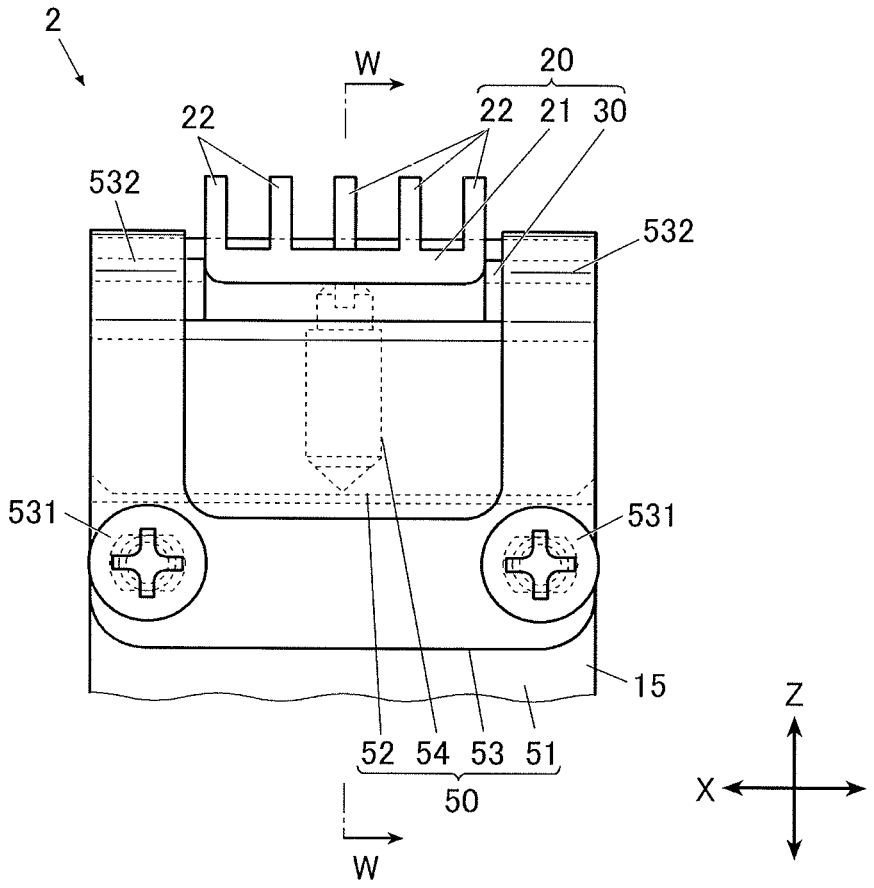
FIG. 2 is a front view illustrating a mounting portion and a feeding dog mounted on the mounting portion.
Figure 3:
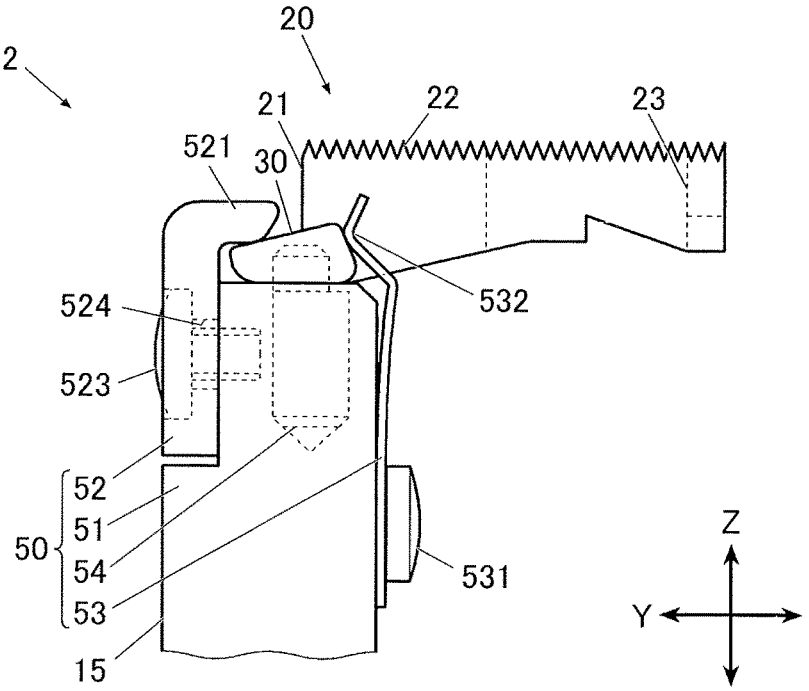
FIG. 3 is a side view illustrating the mounting portion and the feeding dog.
Figure 4:
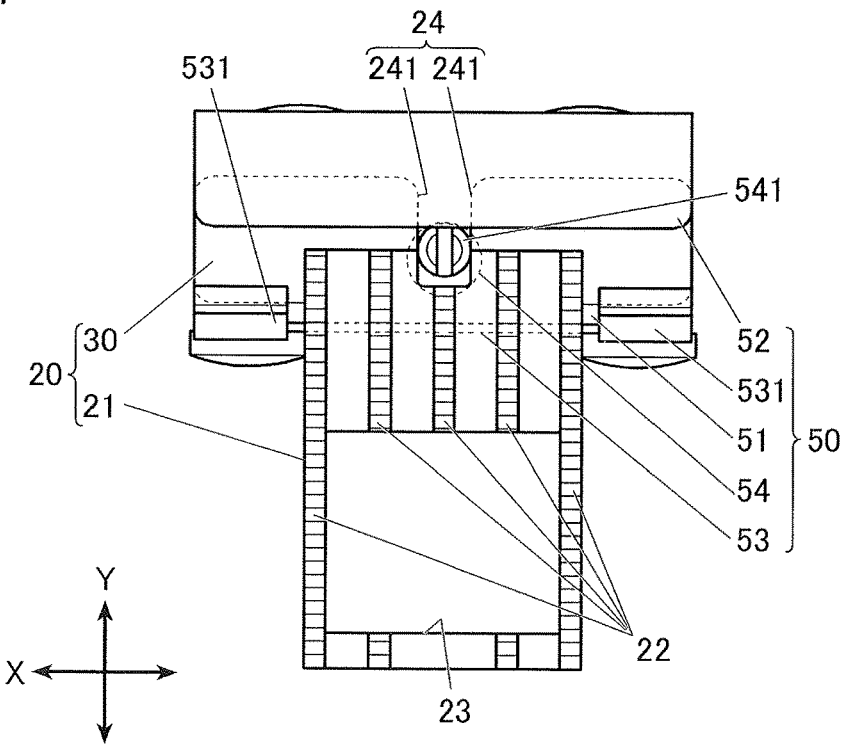
FIG. 4 is a plan view illustrating the mounting portion and the feeding dog.
Figure 5:
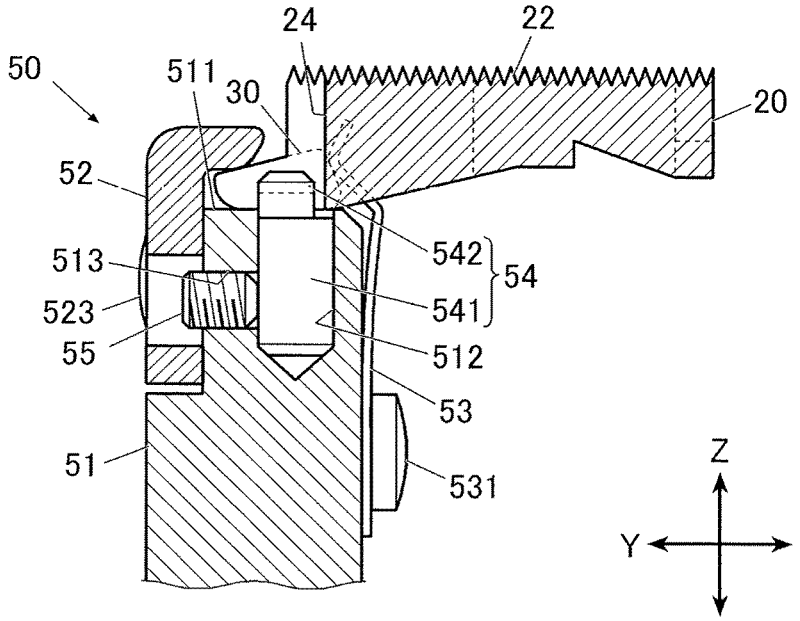
FIG. 5 is a cross sectional view illustrating the mounting portion and the feeding dog taken along the line W-W of FIG. 2.

FIG. 2 is a front view illustrating the mounting portion 50 and the feeding dog 20 mounted on the mounting portion 50, FIG. 3 is a side view, and FIG. 4 is a plan view, FIG. 5 is a cross sectional view taken along the line W-W of FIG. 2.

As illustrated, the feeding dog 20 includes a cam portion 30 which is mounted on the mounting portion 50, a feeding dog portion 22 which transfer the transfer target in a direction of transferring a fabric with contact with a bottom surface thereof in an upper portion 21, an opening 23 through which a needle 11 penetrates to wind an upper thread and a lower thread round between a hook and the needle 11, a positioning recess 24 which positions the feeding dog 20 on the mounting portion 50 in the X-axis direction. In the feeding dog 20, the upper portion 21 has a rectangular shape seen from a plan and five columns of feeding dog portions 22 are formed in the Y-axis direction. Each feeding dog portion 22 has a saw-edge shaped section and acute tips facing upward, and is formed to have high contact resistance to the bottom surface of the fabric.

The cam portion 30 is formed in an end portion of a bottom portion of the feeding dog 20 in the Y-axis direction. The opening 23 having a rectangular shape is formed in another end portion of the middle portion of the feeding dog 20 in the Y-axis direction.

The cam portion 30 has a pillar shape along the X-axis direction, and has the same cross section ranging over the whole length thereof seen from the X-axis direction. The cam portion 30 protrudes to an end side (a front side of a transfer direction, hereinafter, simply referred to as "front side") in the Y-axis direction rather than the upper portion 21 of the feeding dog 20 in which the feeding dog portion 22 are formed, and at the same time, protrudes from the upper portion 21 of the feeding dog 20 to both sides in the X-axis direction. A shape of the cross section of the cam portion 30 seen from the X-axis direction will be described below.

A positioning recess 24 is a concave groove which is formed from an end of the front side of the feeding dog 20 to the rear thereof and in which a circular protrusion 542 of a positioning member 54 of the mounting portion 50 which will be described below is fitted. The positioning recess 24 includes a pair of facing surfaces 241 and 241 parallel to a Y-Z plane, and a gap between the pair of facing surfaces 241 and 241 is equal to a diameter of the circular protrusion 542. When the circular protrusion 542 is circularly moved around the Z axis by a circular operation in the positioning member 54, both ends of the circular protrusion 542 in the X-axis direction is in contact with the facing surfaces 241 and 241 and thus the whole of the feeding dog 20 is moved along the X-axis direction and is positioned in the X-axis direction.

Mounting Portion

The mounting portion 50 includes a basement portion 51 on which the cam portion 30 of the feeding dog 20 is placed, a holding member 52 which is in contact with and hold the cam portion 30 from above, a spring member 53 which presses the cam portion 30 as a pressing member in an insertion direction in which the cam portion is inserted between the basement portion 51 and the holding member 52, and a positioning member 54 which positions the feeding dog 20 in the mounting portion 50 in the X-axis direction.

The basement portion 51 has the same width as that of the cam portion 30 in the X-axis direction, and a top end portion thereof has a planar surface along the X-Y plane. This planar surface is a first receiving surface 511 which is face-to-face contacted with a first cam surface 31 of the cam portion 30, which will be described below (referring to FIG. 7).

The holding member 52 has the same width as that of the basement portion 51 in the X-axis direction and has a planar shape along the X-Z plane. The top end portion thereof is curved in the rear direction to form a curved portion 521.

The curved portion 521 of the holding member 52 has a planar surface along the X-Y plane in a bottom portion thereof, the planar surface facing the first receiving surface 511 of the basement portion 51. This planar surface is a second receiving surface 522 of which an end portion is line-to-line contacted with a second cam surface 32 of the cam portion 30, which will be described below (referring to FIG. 7). That is, another end portion of the second receiving surface 522 in the Y-axis direction (the rear side of the transfer direction, hereinafter simply referred to as "rear side") is formed to have a round corner and circumferential surface 525 around the X axis (referring to FIG. 7), and is line-to-line contacted with the planar second cam surface 32 along the X-axis direction.

The holding member 52 is attached to the front side plane of the basement portion 51 by using a screw 523. The holding member 52 is screwed to the basement portion 51 via a long hole 524 formed along the Z-axis direction. Therefore, when a position of the holding member is controlled in the Z-axis direction while the screw 523 is made to be loose, and thus a gap in the Z-axis direction between the first receiving surface 511 and the second receiving surface 522 is controlled.

A lower portion of the spring member 53 is attached to the rear surface of the basement portion 51 by using a screw 531. An upper portion of the spring member 53 is branched out into two branches, a top end portion of each branch being provided with a pressure contact portion 532 which is curved to have a convex front. These pressure contact portions 532 presses the cam portion 30 in a predetermined direction by independently pressing both ends of a third cam surface 33 (referring to FIG. 7) of the cam portion 30 of the feeding dog 20 in the X-axis direction, which will be described below.

As illustrated in FIG. 5, the positioning member 54 includes a cylindrical main body 541 which is inserted into a circular bottomed hole 512 which is formed downward in the first receiving surface 511 of the basement portion 51, and a circular protrusion 542 which protrudes upward from a top end surface of the main body 541.

The main body 541 can be rotated while being inserted into the bottomed trench 512. The top end surface of the main body 541 is set to be much lower than the first receiving surface 511 when being inserted into the trench 512.

Figure 6:
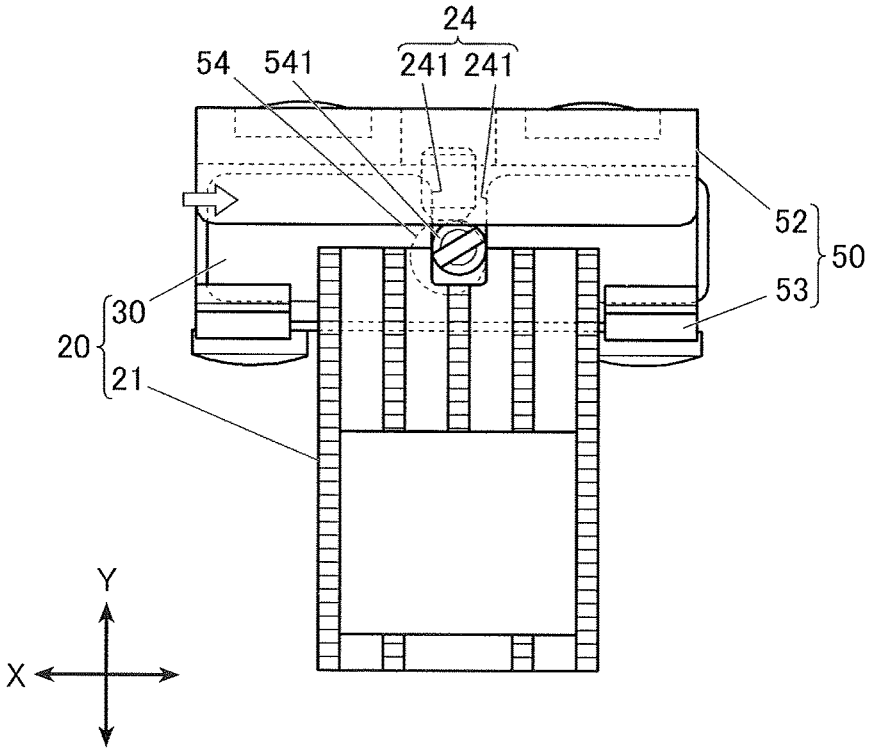
FIG. 6 is a diagram illustrating a state in which a position of the feeding dog is adjusted by a positioning member.

The circular protrusion 542 has a cylindrical shape and is eccentric from the main body 541. A– (minus) groove for a driver is formed on the top end surface to rotate the positioning member 54. As described above, since the circular protrusion 542 is disposed between the pair of facing surfaces 241 and 241 of the positioning recess 24 of the feeding dog 20 as illustrated in FIG. 6, the circular protrusion 542 is circularly moved around a center line of the main body 541 by a rotation operation of the positioning member 54 and thus displacement of the circular protrusion in the X-axis direction is given to the feeding dog 20, thereby positioning the feeding dog in the X-axis direction.

Since a screw hole 513 penetrating the front surface of the basement portion 51 to the bottomed hole 512 into which the positioning member 54 is inserted is formed, a head free screw 55 is screwed into the screw hole 513. This head free screw 55 is screwed to be in contact with an outer periphery of the main body 541 of the positioning member 54 and to fix the positioning member 54, and thus a controlled position of the feeding dog 20 is maintained.

Detachable Structure of Feeding Dog by Cam Portion

Figure 7:
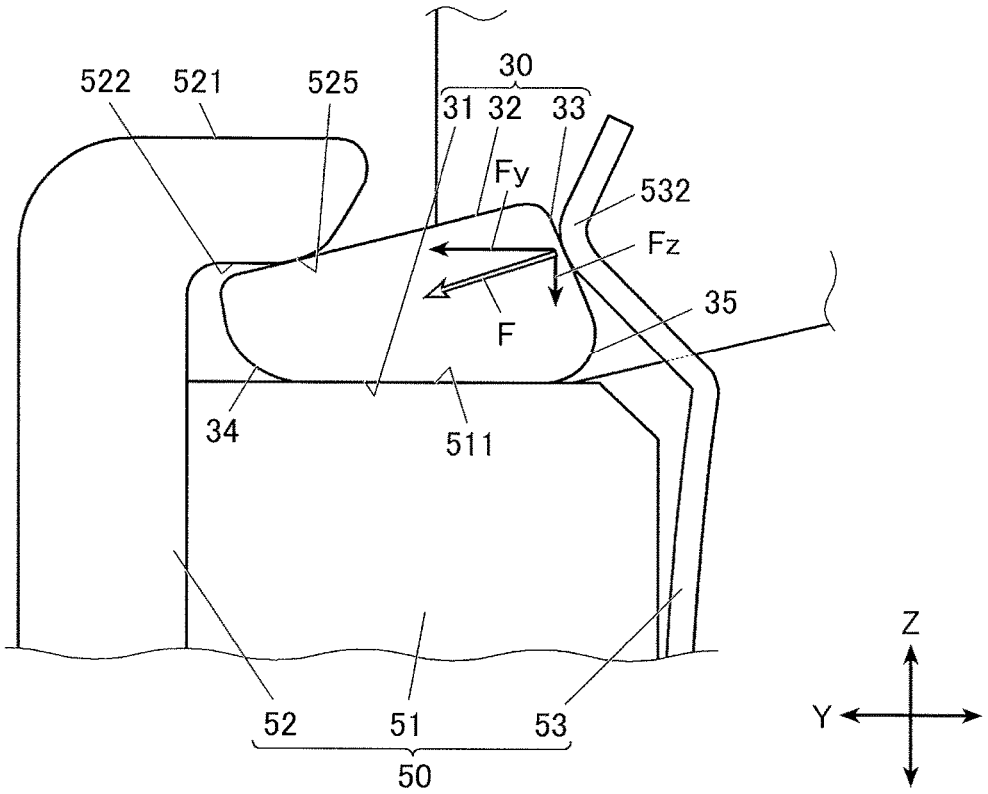
FIG. 7 is a diagram illustrating a state in which a cam portion is supported by neighboring.

FIG. 7 is a diagram illustrating a cam portion 30 supported by neighboring.

The cam portion 30 includes a first cam surface 31 that has a planar shape and is face-to-face contacted with the first receiving surface 511 of the mounting portion 50 in the bottom thereof, a second cam surface 32 that is line-to-line contacted with an end of the second receiving surface 522 of the mounting portion 50 in a direction (X-axis direction) perpendicular to the insertion direction (Y-axis direction) in which the cam portion is inserted in an upper portion thereof, and a third cam surface 33 that is pressed by the pressing member 532 of the spring member 53.

The first cam surface 31 is a horizontal and planar surface, and has a first continuous surface 34 having an arc shape section around the X-axis seen from the X-axis direction in a front end portion (in the insertion direction) thereof. A second continuous surface 35, which is continued to the first cam surface 31 and the third cam surface 33 and has an arc shaped section around the X-axis seen from the X-axis direction, is formed in a rear end portion of the first cam surface 31.

The first cam surface 31 is face-to-face contact with the first receiving surface 511 of the mounting portion 50, and thus a horizontality of a top end portion of the feeding dog 20 is maintained.

The second cam surface 32 is a planar surface and faces upward, and is an inclined surface which is obtained by forward inclining a horizontal plane around the X-axis. Due to this forward incline, the second cam surface 32 is line-to-line contacted with a circumferential surface 525 of a rear end portion of the second receiving surface 522 of the mounting portion 50 in the X-axis direction.

The third cam surface 33 is a planar surface formed in a rear end portion of the cam portion 30, and an upper portion thereof is inclined around the X-axis to be closer to the front with respect to the X-Z plane. The pressure contact portion 532 of the spring member 53 which produces an elastic force in the front direction presses the third cam surface 33.

Thanks to the spring member 53, a vertical pressing force F is input to the cam portion 30 through the third cam surface 33. This pressing force F applied by the spring member 53 can be classified into a force Fz in a direction (Z-axis direction) in which the first cam surface 31 presses the first receiving surface 511 and a force Fy in a direction (Y-axis direction) in which the cam portion 30 is inserted between the first receiving surface 511 and the second receiving surface 522.

That is, when the pressing force F, of which components are classified in the two direction, is inputted in the third cam surface 33, a face-to-face contact between the first cam surface 31 and the first receiving surface 511 and a line-to-line contact between the second cam surface 32 and the second receiving surface 522 are maintained and thus the feeding dog 20 is held to have a suitable position in the Y-axis direction and the Z-axis direction.

A suitable positioning in the X-axis direction of the feeding dog 20 is performed by the positioning recess 24 and the positioning member 54 of the feeding dog 20.

Detachable Operation of Feeding Dog

Figure 8:
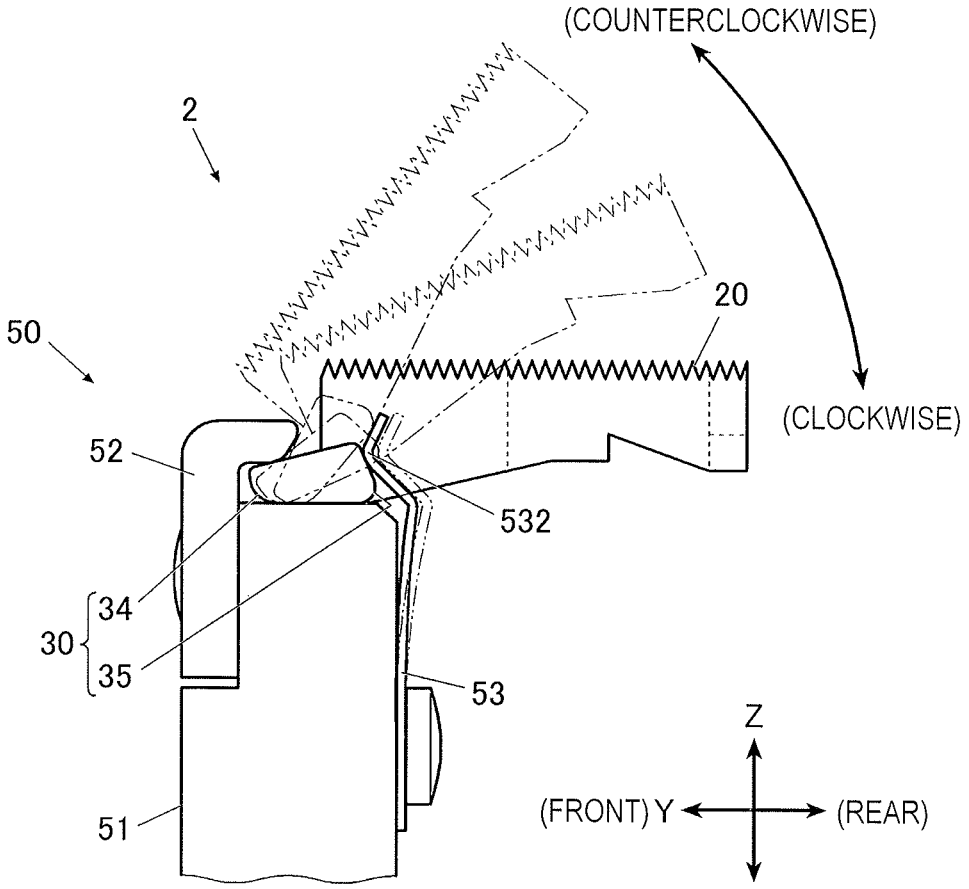
FIG. 8 is a diagram illustrating a detachable operation of the feeding dog.

FIG. 8 is a diagram illustrating a detachable operation of the feeding dog. As illustrated, the feeding dog 20 is detached from the feed dog bracket 15 by pulling up by an end portion (rear end portion) thereof, the end portion being opposite to the cam portion 30 without a work of removing components such as tools and screws.

That is, when an upward pulling force is applied to the rear end portion of the feeding dog 20, the whole feeding dog 20 is rotated in a counterclockwise direction around the first continuous surface 34 of the cam portion 30 as a fulcrum. At that time, the pressure contact portion 532 of the spring member 53 is pushed back to the rear due to the incline of the third cam surface 33, but the rotation of the cam portion 30 is influenced by a lever action and thus the cam portion 30 is relatively easily rotated. Since the second continuous surface 35 is also formed between the first cam surface 31 and the third cam surface of the cam portion 30, the pressure contact portion 532 of the spring member 53 easily passes the second continuous surface 35 as compared with a case that a corner is formed between the first cam surface 31 and the third cam surface 33.

Since the second cam surface 32 is in contact with a distal portion of a curved portion 521 of the holding member 52, the cam portion 30 is moved back. Incidentally, the cam portion 30 is smoothly slid on the first receiving surface 511 thanks to the first continuous surface 34 and thus the cam portion 30 is drawn out between the first receiving surface 511 and a second receiving surface 522.

As a result, the feeding dog 20 is easily detached from the feed dog bracket 15. On the other hand, in a case that the feeding dog 20 is attached on the feed dog bracket 15, the case is performed in a complete reverse operation as compared with the detachment case. That is, while the rear end portion of the feeding dog is inclined to face upward, the front end of the cam portion 30 is inserted between the holding member 52 and the spring member 53 to make the first continuous surface 34 of the cam portion 30 be in contact with the first receiving surface 511, and at the same time, the whole feeding dog 20 is rotated along the continuous surface 34 in a clockwise direction in which the rear end portion is moved downward.

As a result, the distal portion of the cam portion 30 gradually penetrates between the first receiving surface 511 and the second receiving surface 522. At this time, the second continuous surface 35 of the cam portion 30 is in contact with the pressure contact portion 532 of the spring member 53, and passes the pressure contact portion 532 by pressing the pressure contact portion 532 in the rear direction. When the second continuous surface 35 passes the pressure contact portion 532, the pressure contact portion 532 of the spring member 53 presses the third cam surface 33. As a result, the cam portion 30 is pressed in a front direction and a downward direction and stopped, while the first cam surface 31 is face-to-face contacted with the first receiving surface 511 and the second cam surface 32 is line-to-line contacted with the circumferential surface 525 of a rear end of the second receiving surface 522. As a result, the feeding dog is suitably positioned along the Y-axis direction and the Z-axis direction, and is also held in a suitable direction to maintain horizontality of the top end portion of the feeding dog 20.

The feeding dog 20 is led to make the circular protrusion 542 of the positioning member 54 be fitted in the positioning recess 24 of the feeding dog 20 and thus the feeding dog 20 is properly positioned in the X-axis direction.

Feeding Dog for Straight Sewing

Figure 9:
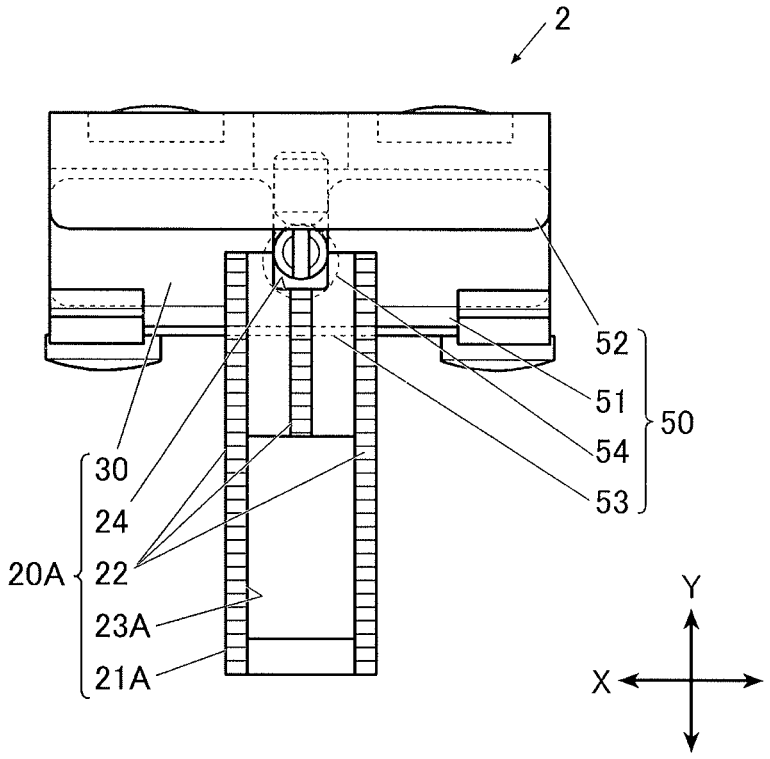
FIG. 9 is a plan view illustrating a feeding dog for a straight sewing.

A feeding dog 20A for the straight sewing, which is exchanged with the feeding dog 20 for the catch stitch, is illustrated in FIG. 9. Regarding this feeding dog 20A, same elements as the feeding dog 20 are denoted by same marks and description thereof will not be repeated.

This feeding dog 20A includes the same cam portion 30 as the feeding dog 20, and an upper portion 21A is formed to have a narrower width rather than the upper portion 21 in the X-axis direction. As a result, the feeding dog portion 22 is reduced from the five columns to the three columns, and a width of an opening 23A is also reduced depending on reduce of a width of the upper portion 21A.

Similarly to the feeding dog 20, this feeding dog 20A includes the cam portion 30, and thus the attachment and removal operations in the feed dog bracket are easily performed, and thus the feeding dog 20 is easily exchanged with the feeding dog 20A.

Technical Effect of the Embodiment

The sewing machine 10 comprises a feed dog bracket 15 in which an operation is given according to a transfer direction in which a fabric is transferred, a feeding dog 20 (or 20A) which transfers the fabric on the throat plate 13, and a mounting portion 50 which detachably mount the feeding dog 20 (or 20A) in the feed dog bracket 15.

In this regard, exchange between feeding dogs 20 and 20A suitable for a stitch pattern is performed, and thus sewing quality can be improved.

The feeding dogs 20 and 20A include the cam portion 30 which is mounted on the mounting portion 50. The mounting portion 50 includes the first receiving surface 511 and the second receiving surface 522 which face each other and the cam portion 30 is inserted into, and the spring member 53 which presses the cam portion 30 in the insertion direction as a pressing member. The cam portion 30 includes a first cam surface 31 which has a planar shape and is face-to-face contacted with the planar first receiving surface 511, a second cam surface 32 which is line-to-line contacted with a circumferential surface 525 of a rear end of the second receiving surface 522 in a direction (X-axis direction) perpendicular to the insertion direction (Y-axis direction) in which the cam portion is inserted in, and a third cam surface 33 which is pressed by the spring member 53. A direction in which the spring member 53 presses the third cam surface 33 is classified into a direction (Z-axis direction) in which the first cam surface 31 presses the first receiving surface 511 and a direction (Y-axis direction) in which the cam portion 30 is inserted between the first receiving surface 511 and the second receiving surface 522.

Accordingly, the face-to-face contact of the first cam surface 31 and the line-to-line contact of the second cam surface 32 are maintained by a pressing force of the spring member 53, and the feeding dogs 20 and 20A are suitably positioned in the Y-axis direction and the Z-axis direction, and at the same time, it is possible to hold suitable posture of the feeding dog 20 without an incline.

By a supporting mechanism constituted by the cam portion 30 and the mounting portion 50, a detachment operation or an attachment operation of the feeding dogs 20 and 20A is easily performed by manually rotating the feeding dogs 20 and 20A without using tools.

Since the cam portion 30 is provided in an end portion of the feeding dogs 20 and 20A in the insertion direction, a lever principle can be used when the transfer tooth 20 or 20A is mounted by a rotation operation. When rigid spring member 53 is used to hold the feeding dogs 20 and 20A, mounting thereof can be easily performed.

In the feeding dogs 20 and 20A, an insertion direction in which the cam portion 30 is inserted in the mounting portion 50 is parallel to a transfer direction in which the fabric is transferred by the feeding dogs 20 and 20A.

As a result, when sewing the fabric, swing in the direction of the feeding dog 20 caused by a transfer resistance force of the fabric hardly occurs, and thus a desirable transfer operation can be performed.

The mounting portion 50 includes the positioning member 54 which positions the feeding dogs 20 and 20A on the mounting portion 50 in a direction (X-axis direction) parallel to the first receiving surface 511 and perpendicular to the insertion direction.

Therefore, when attaching the feeding dogs 20 and 20A, suitable positioning in the X-axis direction can be performed.

Since the cam portion 30 has the first continuous surface 34 which continue on the first cam surface 31 in an end portion (front end portion) of the first cam surface 31 in the insertion direction and has an arc shaped section, when attaching or detaching the feeding dogs 20 and 20A, the feeding dogs 20 and 20A is rotated around the first continuous surface 34, and thus a mounting operation can be smoothly performed.

When the distal portion of the cam portion 30 is inserted into or is pulled out between the first receiving surface 511 and the second receiving surface 522, the first continuous surface 34 is smoothly slid on the first receiving surface 511 and thus the mounting operation can be more smoothly performed.

The spring member 53 includes the pressure contact portion 532 which presses the third cam surface 33, and the cam portion 30 includes the second continuous surface 35 which continues on the first cam surface 31 and the third cam surface 33 and has an arc shaped section. Therefore, when attaching or detaching the feeding dogs 20 and 20A, a part thereof positioned between the first cam surface 31 and the third cam surface 33 smoothly pass the pressure contact portion 532, and thus the mounting operation can be more smoothly performed.

Others

In the above-mentioned embodiments, the spring member 53 is exemplified as the pressing member, but a different member or mechanism may be also used when pressing the third cam surface 33 of the cam portion 30.

Figure 10:
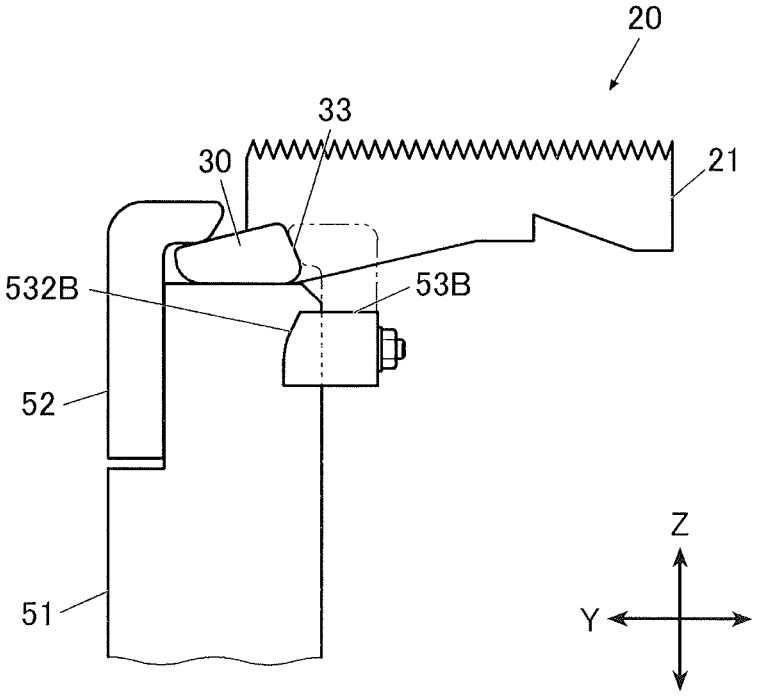
FIG. 10 is a side view illustrating the mounting portion including a lever member as a pressing member.

For example, a latch mechanism having a claw capable of advancing is provided in the basement portion 51 of the feed dog bracket 15, and a claw elastically pressed in a protrusion direction is provided against the third surface 33 of the cam portion 30. In this case, the feeding dogs 20 and 20A are attached or detached by retracting the claw against elastic force, and a pressing force of the claw holds the feeding dogs 20 and 20A in the mounting portion 50. That is, the claw serves as the spring member 53. As illustrated in FIG. 10, a lever member 53B which can be switched from a pressure contact position in the third cam surface 33 into a position retracted back from the third cam surface 33 can be used as the pressing member.

That is, the lever member 53B is convertibly supported in the rear surface of the basement portion 51 in the Y-axis direction, and thus the lever member 53B can be switched from a state (retraction position, illustrated in a solid line) in which a rotational end portion faces outward from the side thereof into a state in which the rotational end portion is upstanding (pressure contact position, illustrated in a two-dot chain line).

The rotation end portion of the lever member 53B has a front protrusion shape, and an end portion of the protrusion serves as a pressure contact portion 532B and presses the third cam surface 33. Therefore, the cam portion 30 has a configuration in which a front portion and a lower portion thereof are pressed.

At this time, as indicated by a solid line, it is desirable that the pressure contact portion 532B of the rotation end portion of the lever member 53*b* has a contact surface of the distal portion, the contact surface having a curved surface or an inclined surface in order to make greater protrusion portion gradually to the front have a contact portion along converting from a positioned retracted into a position of pressure contact. As a result, according to the rotation of the lever member 53B, the third cam surface 33 of the cam portion 39 is gradually pressed in the front direction. Only a lever member 53B being in contact with one side of the third cam surface 33 of the cam portion 30 is illustrated in FIG. 10, but a lever member being in contact with the other side of the third cam surface 33 is provided. It is also desirable that the distal portion of the other side lever member has a contact surface of which a curve direction or an incline direction is set symmetric.

What is claimed is:

1. A sewing machine in which a presser foot and a throat plate are detachable in accordance with a stitch pattern, the sewing machine comprising:

a feed dog bracket that is driven according to a transfer direction in which a fabric is transferred;

a feeding dog that transfers the fabric on the throat plate; and a mounting portion that detachably mounts the feeding dog on the feed dog bracket, wherein the feeding dog includes a cam portion which is mounted on the mounting portion, and wherein the mounting portion includes:

a planar first receiving surface and a second receiving surface on which the cam portion is inserted and which are formed in positions opposing to each other; and a pressing member which presses the inserted cam portion which is inserted between the first and second receiving surfaces, in an insertion direction, and wherein the cam portion includes:

a first cam surface which is a planar surface, which has a planar, surface-contact with the planar first receiving surface such that the feeding dog is maintained horizontal, and which is configured to slide on the planar first receiving surface;

a second cam surface which has a line-contact with an end portion of the second receiving surface in a direction perpendicular to the insertion direction in which the cam portion is inserted and which is an inclined surface with respect to the first cam surface; and a third cam surface which is pressed by the pressing member, wherein between the first cam surface and the second cam surface is a continuous surface having an arc shape section.

2. The sewing machine according to claim 1, wherein a direction in which the pressing member presses the third cam surface is divided into a pressing direction in which the first cam surface presses the first receiving surface and the insertion direction in which the cam portion is inserted between the first and second receiving surfaces.

3. The sewing machine according to claim 1, wherein the cam portion is arranged at an end portion of the feeding dog in the insertion direction.

4. The sewing machine according to claim 2, wherein the cam portion is arranged at an end portion of the feeding dog in the insertion direction.

5. The sewing machine according to claim 1, wherein the insertion direction of the cam portion is parallel to a direction in which the fabric is transferred by the feeding dog.

6. The sewing machine according to claim 2, wherein the insertion direction of the cam portion is parallel to a direction in which the fabric is transferred by the feeding dog.

7. The sewing machine according to claim 1, wherein the mounting portion includes a positioning member which positions the feeding dog on the mounting portion, in a direction which is parallel to the first receiving surface and which is intersected with the insertion direction.

8. The sewing machine according to claim 2, wherein the mounting portion includes a positioning member which positions the feeding dog on the mounting portion, in a direction which is parallel to the first receiving surface and which is intersected with the insertion direction.

9. The sewing machine according to claim 1, wherein the continuous surface is formed at an end portion of the first cam surface in the insertion direction.

10. The sewing machine according to claim 2, wherein the continuous surface is formed at an end portion of the first cam surface in the insertion direction.

11. The sewing machine according to claim 1, wherein the pressing member includes a pressure contact portion which presses the third cam surface, and wherein the cam portion has further includes a second continuous surface between the first cam surface and the third cam surface, the second continuous surface having an arc shaped section.

12. The sewing machine according to claim 2, wherein the pressing member includes a pressure contact portion which presses the third cam surface, and wherein the cam portion has further includes a second continuous surface between the first cam surface and the third cam surface, the second continuous surface having an arc shaped section.

13. The sewing machine according to claim 11, wherein the pressing member is a spring member which has the pressure contact portion.

14. The sewing machine according to claim 12, wherein the pressing member is a spring member which has the pressure contact portion.

15. The sewing machine according to claim 11, wherein the pressing member is a latch mechanism which has the pressure contact portion.

16. The sewing machine according to claim 12, wherein the pressing member is a latch mechanism which has the pressure contact portion.

17. The sewing machine according to claim 1, wherein the pressing member is a lever member which switches a position where the pressing member presses the third cam surface and a position where the pressing member is retreated from the third cam surface.

18. The sewing machine according to claim 2, wherein the pressing member is a lever member which switches a position where the pressing member presses the third cam surface and a position where the pressing member is retreated from the third cam surface.

* * * * *